United States Patent [19]

Shimizu et al.

[11] Patent Number: 4,762,579

[45] Date of Patent: Aug. 9, 1988

[54] PROCESS FOR PRODUCING EASILY OPENABLE CLOSURE

[75] Inventors: Takashi Shimizu, Yokohama; Hiroshi Matsubayashi, Kamakura; Michio Watanabe, Yokohama; Kazumi Hirota, Tokyo; Naoto Watanabe; Kikuo Matsuoka, both of Yokohama, all of Japan

[73] Assignee: Toyo Seikan Kaisha, Ltd., Tokyo, Japan

[21] Appl. No.: 937,001

[22] Filed: Dec. 2, 1986

[30] Foreign Application Priority Data

| | | | |
|---|---|---|---|
| Dec. 3, 1985 | [JP] | Japan | 60-270657 |
| Dec. 27, 1985 | [JP] | Japan | 60-293272 |
| Jun. 12, 1986 | [JP] | Japan | 61-135001 |
| Jun. 12, 1986 | [JP] | Japan | 61-135002 |

[51] Int. Cl.[4] ..... B32B 31/12

[52] U.S. Cl. ..... 156/69; 156/256; 156/324; 220/269; 220/270; 220/359; 413/12

[58] Field of Search ..... 156/69, 324, 256; 220/269, 270, 271, 359; 413/12, 14, 15

[56] References Cited

U.S. PATENT DOCUMENTS

| | | | |
|---|---|---|---|
| 4,210,091 | 7/1980 | Erba | 413/12 X |
| 4,213,324 | 7/1980 | Kelley et al. | 413/15 X |
| 4,232,622 | 11/1980 | Weierman et al. | 156/69 X |
| 4,373,978 | 2/1983 | Patterson | 156/69 |
| 4,462,732 | 7/1984 | Bloeck | 156/69 X |
| 4,529,468 | 7/1985 | Bloeck et al. | 156/69 X |
| 4,568,230 | 2/1986 | Brown | 413/14 X |
| 4,624,386 | 11/1986 | Grigorenko et al. | 220/269 |

*Primary Examiner*—Robert A. Dawson

*Attorney, Agent, or Firm*—Wenderoth, Lind & Ponack

[57] ABSTRACT

A process for producing an easily openable closure including the steps of producing a closure body by subjecting a shell formed from a metal blank to panel formation, score formation for defining a portion to be opened, bead formation while the shell is intermittently moved for producing a tab, placing a bonding surface of the closure body opposite to a bonding surface of the tab, and bonding the bonding surface of the tab to the bonding surface of the closure body with an adhesive while the closure body and the tab are continuously moved.

30 Claims, 8 Drawing Sheets

PROCESS FOR PRODUCING EASILY OPENABLE CLOSURE

BACKGROUND OF THE INVENTION

1. Field of the Invention

This invention relates to a process for producing an easily openable closure, and more specifically, to a process for producing an easily openable closure in which the production efficiency is markedly increased by an optimum combination of intermittent driving and continuous driving operations.

2. Description of the Prior Art

Rivet method

A rivet method has previously been known for attaching a tab to a closure body.

According to this method, a substantially disc-like shell body having a curled peripheral part is produced from a metal blank. The shell body is then subjected to a panel forming step of providing a raised or depressed part for easy insertion of a finger between a tab to be fixed later and the closure body, a score forming step of providing a score defining a portion to be opened, and a bead forming step of providing a bead for removal of strains caused by the score formation. As a result, a closure body is produced. A tab is then mechanically attached to the closure body. The mechanical attaching of the tab is carried out by performing on the closure body a bubbling step of forming a protrusion of a shape defining part of a spherical surface, a bubble reforming step of increasing the height of the protrusion, and a buttoning step of further increasing the height of the protrusion successively. Then, the protrusion of the closure body formed in the manner discussed above is placed in a small hole of the tab and hammered to connect the tab mechanically to the closure body. To place the protrusion in the small hole of the tab and connect it mechanically, the protrusion should have a certain height. This height cannot be obtained by a single step, and as stated above, three steps consisting of bubble forming, bubble reforming and buttoning are required.

Because of the need for such many steps, the rivet method has the disadvantage of being unable to attain an increased production efficiency. In recent years, it was proposed to form closure bodies from a hard material in order to increase closure openability. While the openability of the closure can be increased if the closure body is produced from a hard material, it is impossible or extremely difficult to provide a high protrusion on the closure body.

Conventional bonding method

A method of bonding a tab and a closure body by an adhesive was proposed instead of the rivet method.

According to this method, the closure body is subjected to a step of panel formation, a step of score formation and a step of bead formation, but it is not necessary to provide a protrusion rn the closure body. Hence, the closure body itself can be produced considerably rapidly. On the other hand, in the step of bonding the tab to the closure body, it is necessary to hold the adhesive between the tab and the closure body and press them for a predetermined period of time whether the adhesive is a thermoplastic adhesive or an instant adhesive. The time required for the pressing is several times as long as the time required for performing each of the panel formation, score formation and bead formation steps. Accordingly, if the panel formation, score formation and bead formation are carried out on the closure body while the closure body is being moved by intermittent driving and the bonding step is carried out in the same way as in these steps, the production speed cannot be increased despite simplification of the process as compared with the prior method.

Proposed improvement

In view of the above state of the art, the present inventors worked extensively in order to provide an improvement in the aforesaid process for producing a closure, and have found that closures can be produced with an increased production efficiency by separating the bonding step from the panel formation steps, and score formation and bead formation, carrying out the panel formation, score formation and bead formation steps by intermittent driving and carrying out the bonding step by continuous driving.

Usually, the panel formation, score formation and bead formation steps are carried out by press working. By press working, the closure body can be produced rapidly by providing a fixed die and a shell body that is driven intermittently.

In the bonding step, the closure body should be maintained in a pressed state for a relatively long period of time as stated above. Thus, if a pressing device is fixedly provided and the closure body is intermittently driven, the closure body must be pressed while it is at a stop, and the working speed is reduced considerably. It may be possible to construct the pressing device such that it is intermittently driven together with the closure body in order to increase the working speed. However, since the pressing device is relatively heavy, it cannot be rapidly driven intermittently, and the production efficiency is low.

If, on the other hand, the closure body is continuously driven and a plurality of pressing devices are continuously moved together with the closure body, the bonding can be effected rapidly. Furthermore, since the relatively heavy pressing devices are moved continuously, they can be moved at high speeds.

Closures can be produced with a high production efficiency if, as stated above, the panel formation, score formation and bead formation steps are carried out by intermittent driving and the bonding step is carried out by continuous driving. However, this improved process gives rise to a new problem. The problem is that at the time of changing from intermittent driving to continuous driving, variation occurs in the angular direction and position of the closure body, and subsequent bonding of the closure body and the tab cannot be effected properly.

This problem will be described in more detail. There are, for example, two methods of linking intermittent driving to continuous driving. One method is to provide a continuously moving belt or turntable at a point of connection between intermittent driving and continuous driving, and the other is to provide a stationary receiver at a point of connection between intermittent driving and continuous driving.

In the first method, the closure body supported on an intermittently rotating plate is pushed out onto a continuously moving belt or turntable by, for example, a pushing punch, and placed on it while the rotating plate is at a stop. At the time of placing the closure body on the continuously moving belt or turntable, it temporarily becomes free and unrestrained and slides on the moving belt or turntable. Consequently, closure bodies on the belt or turntable considerably differ from each other in horizontal and angular positions, and cannot be properly positioned with respect to tabs in the subsequent step of bonding.

According to the second method, the closure body supported on an intermittently rotating plate is placed on the receiver at a stop by, for example, a pushing punch while the rotating plate is at a stop, and the closure placed on the receiver is put on a continuously moving belt or turntable. The closure body can be positioned on the receiver from the rotating plate at a stop without variations in its horizontal and angular positions. To transfer the closure on the receiver to the belt or turntable, the closure body on the receiver at a stop is pushed by a lever provided in the belt or turntable so that it moves together with the belt or turntable. When the closure body on the stationary receiver is pushed by the lever, its angular position deviates due to sliding between the closure body and the receiver. For this reason, relative angular positioning between the closure body and the tab cannot be properly effected at the time of bonding the closure and the tab, and this leads to production of many closures having poor quality.

Furthermore, when bonding the adhesive to the bonding surface of the tab, the bonding surface must be pressed for a certain period of time. This pressing time should be several times as long as the time required for each mechanical working step such as panel formation, score formation and bead formation.

SUMMARY OF THE INVENTION

It is an object of this invention to provide a process for producing an easily openable closure wherein panel formation, core formation and bead formation and a bonding step can be rapidly and advantageously carried out.

Another object of this invention is to provide a process for producing an easily openable closure wherein intermittent driving during panel formation, core formation and bead formation can be properly linked to continuous driving in the bonding step.

Still another object of this invention is to provide a process for producing an easily openable closure rapidly wherein an adhesive is applied to a metal blank and a tab is formed from the metal blank, the adhesive can be applied to the metal blank rapidly, and the positioning of the adhesive is very easy.

Yet another object of this invention is to provide a process for rapidly producing an easily openable closure wherein during the step of producing a closure body, a drawing step and at least one of panel formation and bead formation which are non-circular workings are simultaneously carried out.

The above and other objects of this invention are achieved by a process for producing an easily openable closure, which comprises:

producing a closure body by subjecting a shell to panel formation, score formation for defining a portion to be opened and bead formation while the shell is intermittently moved, producing a tab, placing a bonding surface of the closure body opposite to a bonding surface of the tab, and bonding the bonding surface of the tab to the bonding surface of the closure body by an adhesive while the closure body and the tab are continuously moved.

The above and other objects of this invention are also achieved by a process for producing an easily openable closure, which comprises:

producing a closure body by subjecting a shell to panel formation, score formation for defining a portion to be opened and to bead formation while the shell is intermittently moved, applying an adhesive to a metal blank and forming a tab from the metal blank having the adhesive applied thereto, and bonding the tab to the closure body by the adhesive while the closure body and the tab are continuously moved.

DETAILED DESCRIPTION OF THE PREFERRED EMBODIMENTS

With reference to FIGS. 1 to 14, the process of this invention in accordance with one embodiment will be generally described.

An apparatus used to carry out the process in accordance with this embodiment includes a tab producing section 10, a closure body producing section 12, a direction matching section 14 and a bonding section 16.

Figure 2:
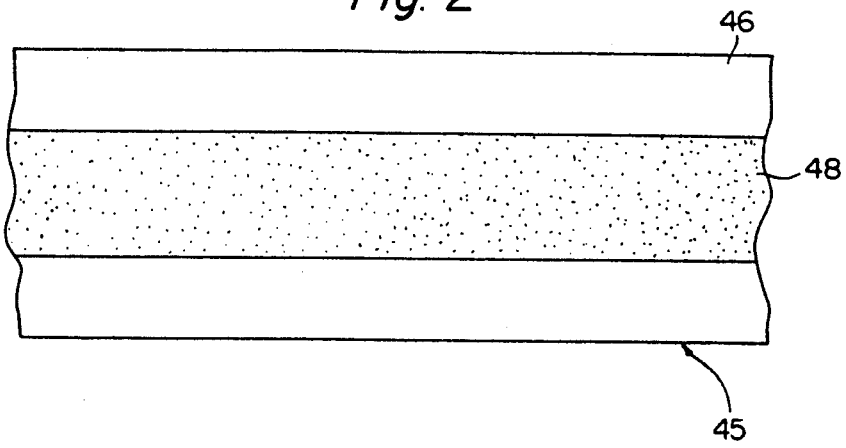
FIG. 2 is a top plan view of a tape-like material formed by applying an adhesive film to a metal blank in a tab producing section.

In the tab producing section 10, an adhesive is applied to a metal blank to produce a tape-like material 45 shown, for example, in FIG. 2. A tab 20 (FIGS. 3*a* and 3*b*)- is produced from the tape-like material 45.

Figure 6A:
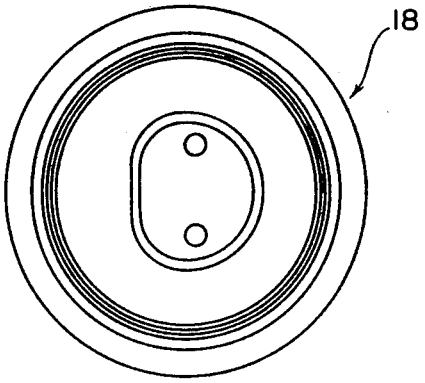
FIGS. 6*a* and 6*b* are a top plan view and a partial cross-sectional view of the shell on which scores have been formed.
Figure 6B:
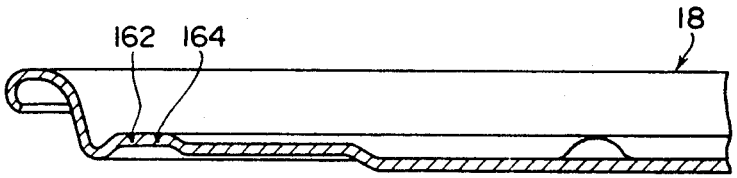
Figure 7A:
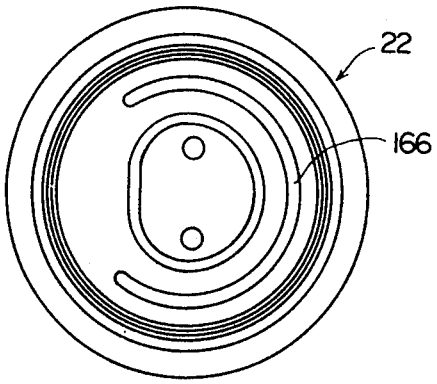
FIGS. 7*a* and 7*b* are a top plan view and a cross-sectional view of the shell on which a bead has also been formed.
Figure 7B:
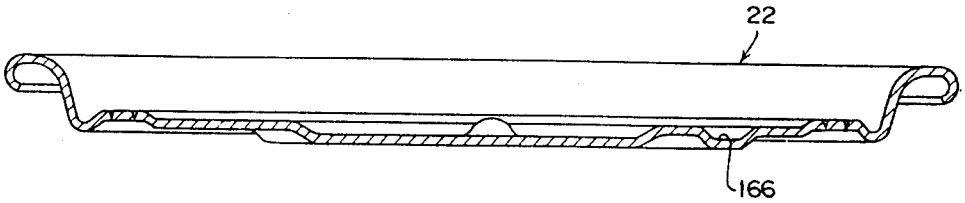

In the closure body producing section 12, a shell 18 (FIGS. 4*a* and 4*b*) is fed and successively subjected to a step of panel formation (FIGS. 5*a* and 5*b*), a step of score formation (FIGS. 6*a* and 6*b*) and a step of bead formation (FIGS. 7*a* and 7*b*). It is turned upside down and sent to the direction matching section 14.

The direction matching section 14 holds the closure body 22 fed from the closure body producing section 12 at a predetermined angular direction on a holding member 216 of a direction matching device 24, and feeds the closure body to the bonding section.

Figure 8B:
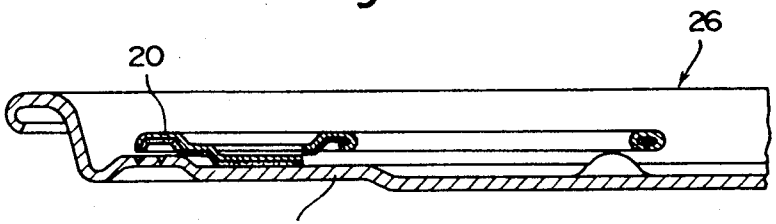
FIGS. 8*a* and 8*b* are a top plan view and a partial cross-sectional view of a closure produced by the apparatus of FIG. 1.
Figure 8A:
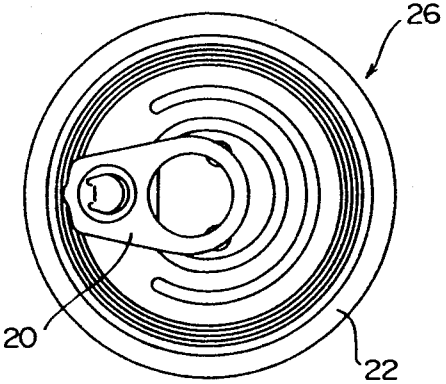

In the bonding section 16, the tab 20 is bonded to the closure body 22 to produce a closure 26 (FIGS. 8*a* and 8*b*).

Tab producing section

The tab producing section 10 will be described with reference to FIGS. 1 to 3*b*, 9 and 10.

The tab producing section 10 includes a bonding device 11, a tab press 13 and a tab feed mechanism 201.

Figure 9:
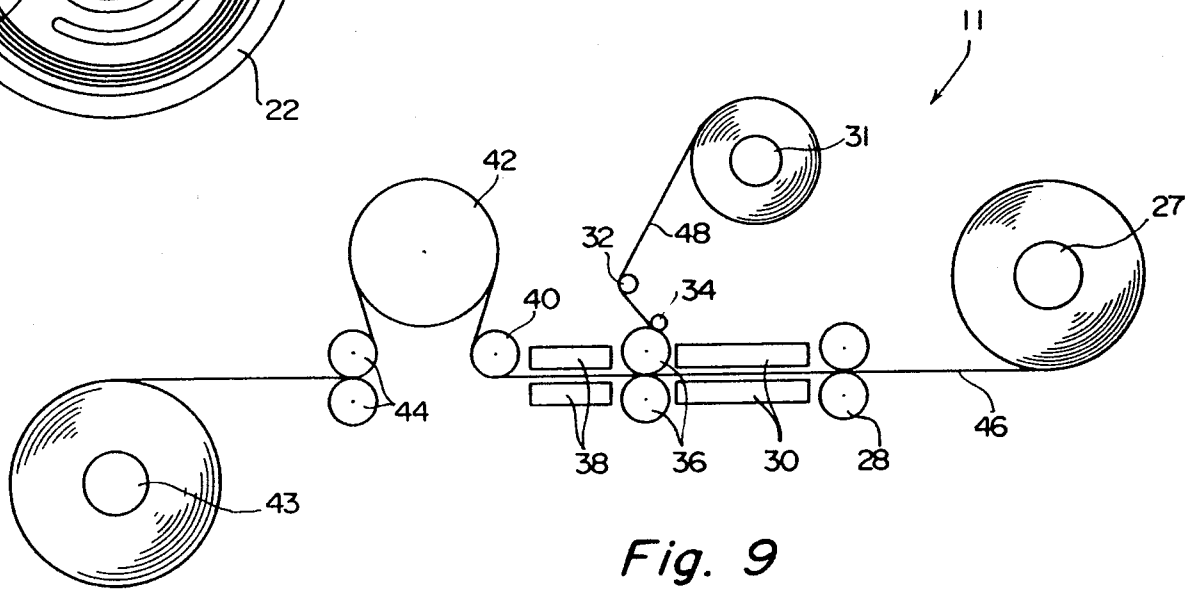
FIG. 9 is a side elevation of a bonding device in the tab producing section of the apparatus shown in FIG. 1.

As shown in FIG. 9, the bonding device 11 is comprised of a first supporting roll 27, a tension roll 28, a first heating coil 30, an adhesive tape supporting roll 31, a first guide roll 32, a second guide roll 34, a laminator roll 36, a second heating coil 38, a third guide roll 40, a cooling roll 42, a driving roll 44 and a second supporting roll 43.

The tension roll 28 is adapted to guide a tape-like metal blank 46 supported in coil form on the supporting roll 27 and to resist the moving of the metal blank 46. On the other hand, the driving roll 44 is adapted to drive and advance the tape-like metal blank 46 to which an adhesive film 48 is applied. Hence, in the bonding device 11, the tape-like metal blank 46 is continuously advanced under a predetermined tension by the action of the tension roll and the driving roll 44.

The first and second guide rolls 32 and 34 guide the adhesive film 48 supported by the adhesive tape supporting roll 31 to the laminator roll 36.

The first heating coil 30 heats the tape-like metal blank 46 to a temperature at which only the adhering surface of the adhesive film 48 becomes substantially tacky. Then, the laminator roll 36 presses the tape-like metal blank 46 and the adhesive film 48 to bond them provisionally.

The second heating coil 38 heats the provisionally bonded metal blank 46 to a temperature at which the entire adhesive film 48 is fully melted. As a result, the tape-like metal blank 46 and the adhesive film 48 are firmly bonded to each other.

The metal blank 46 having the adhesive film 48 applied thereto is then fed to the cooling roll 42 via the third guide roll 40, cooled there, discharged from the bonding device 11 by the driving roll 44, and held in coil form by the second supporting roll 43.

The adhesive film 48 has a smaller width than the tape-like metal blank 46 as shown in FIG. 2, and is preferably connected to the center of the metal blank 46. In this case, the first and second heating coils 30 and 38 are preferably constructed such that they heat only the central portion of the metal blank 46.

If desired, the adhesive film 48 may be applied to the entire surface of the metal blank 46.

It is also possible to provide a device for cutting the adhesive film 48 in the bonding device 11 whereby, for example, a plurality of circular pieces of the adhesive film 48 may be disposed at predetermined intervals on the metal blank 46.

If desired, the metal blank 46 may be heated to a temperature above the melting point of the adhesive by the first heating coil 30, and the second heating coil 38 may be omitted.

Figure 10:
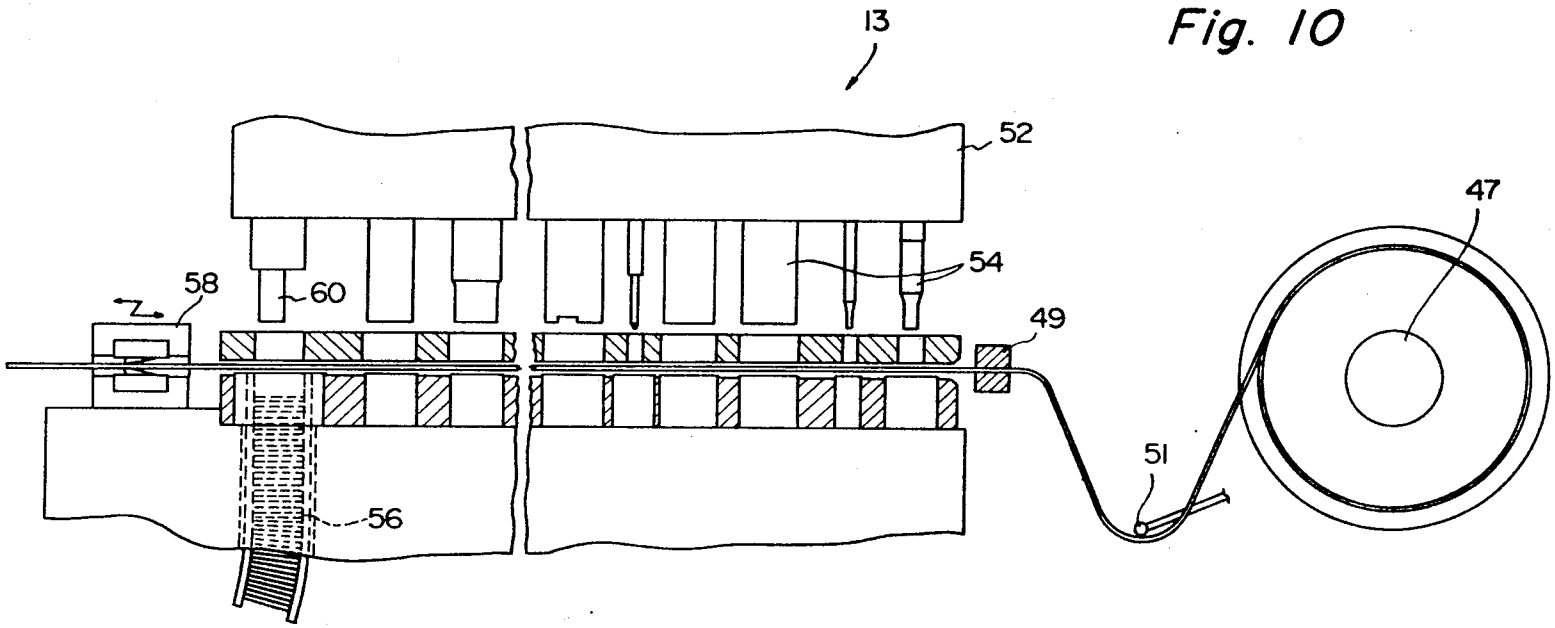
FIG. 10 is a side elevation of a tab press in the tab producing section of the apparatus shown in FIG. 1.
Figure 11:
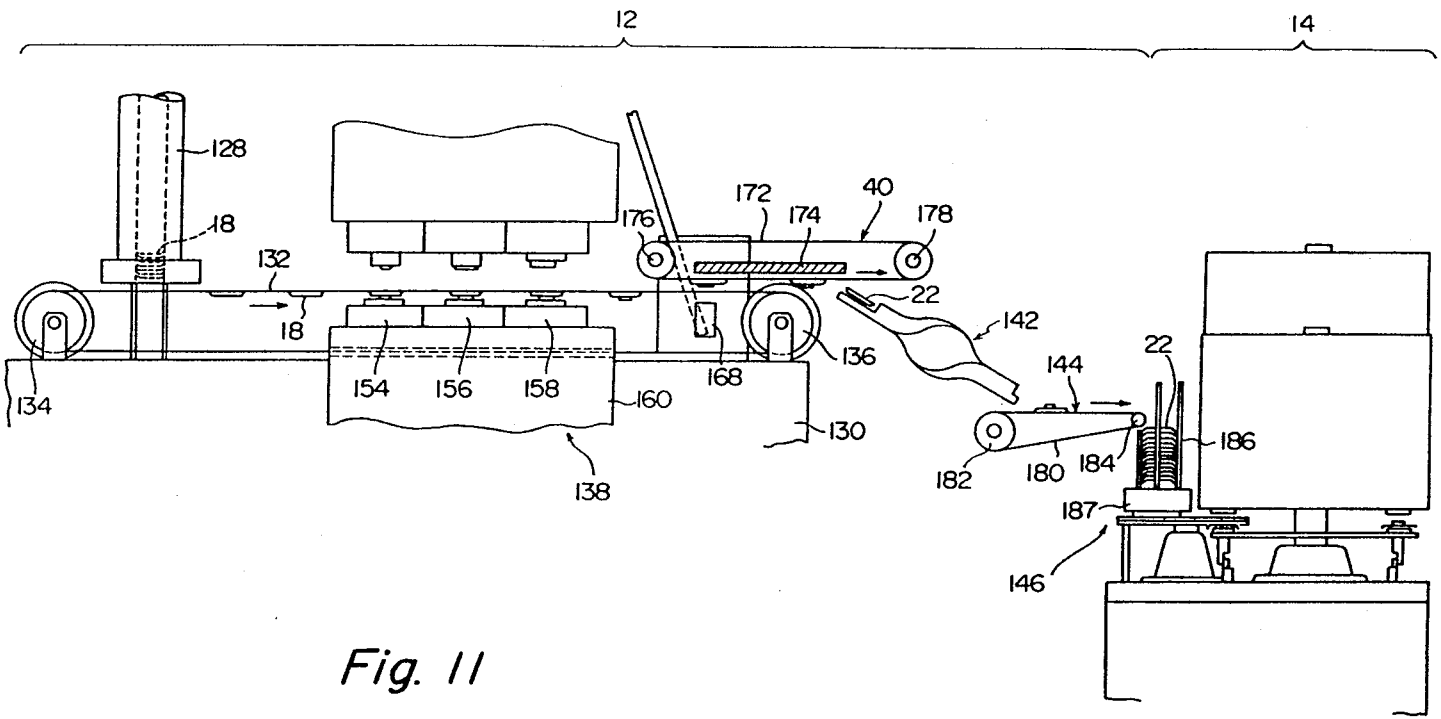
FIG. 11 is a side elevation partly showing a closure body producing section and a direction matching section of the apparatus shown in FIG. 1.

The metal blank 46 having the adhesive film 48 applied thereto by the bonding device 11 is temporarily held, for example in a coil form, and then fed to the tab press 13 (FIG. 10).

As shown in FIG. 10, the tab press 13 as in a conventional press, is comprised, for example, of a supporting roll 47, a lubricant oil applicator 49, a detector bar 51 for detecting the amount of the tab material delivered, a single pressing device 52, a plurality of dies 54 provided in the pressing device 52, a guide 56 and a delivery device 58.

The supporting roll 47 supports the metal blank 48 in coil form having the adhesive film 48 applied thereto by the bonding device 11, and the metal blank 46 is sent to the lubricant oil applicator 49 via the detector bar 51. The detector bar 51 detects the amount of deflection of the metal blank 46 and a signal produced by the detector bar 51 is used to control delivery of the tab material. The lubricant oil applicator 49 supplies a lubricant oil to the metal blank 46 so that it can be well pressed.

The delivery device 58 intermittently moves the metal blank 46 having the adhesive film 48 applied thereto, and in synchronism with the movement of the metal blank 46, the pressing device 52 drives the dies 54.

Figure 3A:
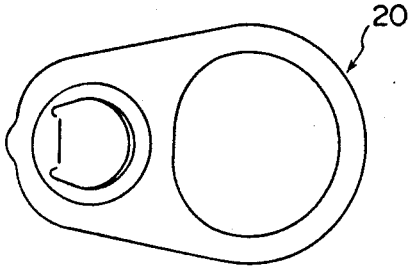
FIGS. 3*a* and 3*b* are a top plan view and a cross-sectional view of a tab.
Figure 3B:
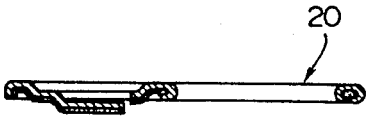

The dies 54 successively work the metal blank 46 having the adhesive film 48 and supplied from the supporting roll 47, and then the blank is punched by a punching die 60, the last die, to form a final tab 20 shown, for example, in FIGS. 3*a* and 3*b*. The tab 20 is sent to a tab stacker 202 (FIG. 1) of a tab feed mechanism 201 via the guide 56 disposed beneath the punching die 60.

The tab feed mechanism 201 has the tab stacker 202 and a roller 206 with a plurality of clamp members 204.

Tabs 20 sent from the guide 56 of the tab press 13 are stacked in the tab stacker 202 with the adhesive-applied surfaces facing upwardly. The tabs 20 are pushed out one by one toward the roller 206 by a tab separating punch (not shown). The roller 206 is rotating continuously, and the clamp members 204 support the tab 20 and advance it toward the bonding section.

Instead of the aforesaid construction, it is possible to produce tabs at another site, apply an adhesive to only desired portions, thereof and feed them successively to the tab stacker.

Closure body producing section

The closure body producing section 12 will further be described in detail with reference to FIGS. 1, 4*a* to 7*b*, and 11.

The closure body producing section 12 includes a shell feed device 128, a stand 130 on which the shell feed device 128 is disposed, a conveyor belt 132, a driving wheel 134, an idler wheel 136, a press 138, a first moving conveyor device 140, a reversing device 142, a second moving conveyor device 144, and a feed device 146.

The shell feed device 128 is placed on the stand 130, and feeds shells 18, produced in advance, from a shell stacker one by one to a predetermined position of the conveyor belt 132 as the conveyor belt 132 moves. Instead of the shell fed device 128, it is possible to combine a device for producing shells 18 from a metal blank with the conveyor belt 132.

Figure 4A:
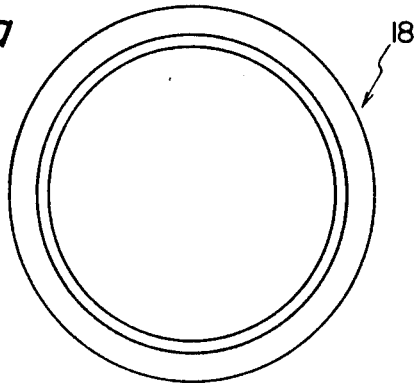
FIGS. 4*a* and 4*b* are a top plan view and a partial cross-sectional view of a shell worked by the apparatus shown in FIG. 1.
Figure 4B:
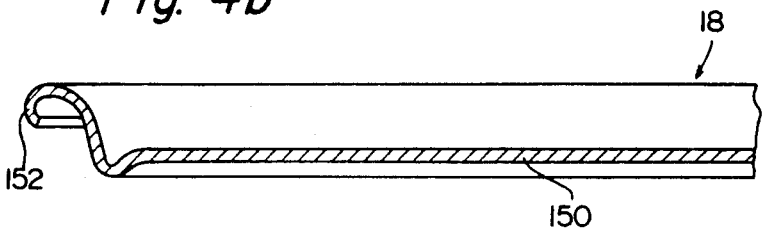

The conveyor belt 132 is supported by the driving wheel 134 and the idler wheel 136 provided on the stand 130 and is intermittently driven by the driving wheel 134 intermittently driven by a driving device (not shown). Circular openings 148 spaced at equal intervals are formed on the conveyor belt 132. Each of the openings 148 has a slightly larger diameter than the diameter of the bottom portion 150 of the shell 18 (FIGS. 4*a* and 4*b*). As a result, the shell 18 fed to the opening 148 of the conveyor belt 132 from the shell feed device is supported by the conveyor belt 132 at its curled portion 152 and its bottom portion 150 projects from the opening 148.

The press 138 has three sets of dies 154, 156 and 158 and a pressurizing device 160 for holding and pressurizing these dies 154, 156 and 158.

Figure 5A:
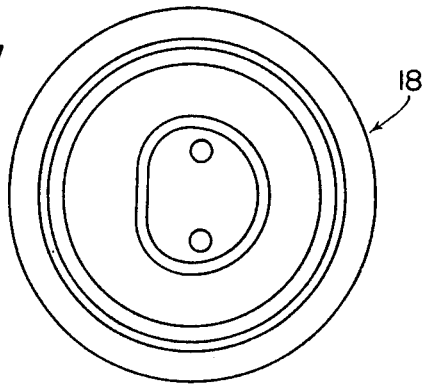
FIGS. 5*a* and 5*b* are a top plan view and a partial cross-sectional view of the shell on which a panel has been formed.
Figure 5B:
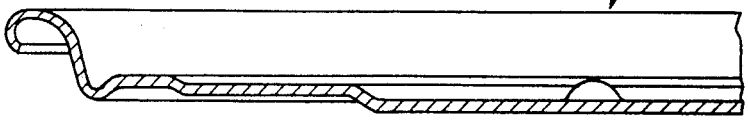

The first die 154 forms a panel on the shell 18 having the form shown in FIGS. 4*a* and 4*b*, the shell having been fed from the shell feed device 128 and disposed in the opening 148 of the conveyor belt 132, to thereby provide the worked shell having the form shown in FIGS. 5*a* and 5*b*. The purpose of performing this working is to make it easy to insert a finger between the closure body and the tab to be attached later and thus make it easy to open the closure.

The second die 156 forms two scores 162 and 164 shown in FIGS. 6*a* and 6*b* on the shell 18 on which the panel has been formed in the manner described above. The outside first score 162 defines an opening of the closure. When the tab in the final closure is pulled, the closure is cut along the first score 162 to form an opening. The second score 164 serves to prevent occurrence of cracking between the bottom portion of the first score 162 and the back surface of the closure. It is possible to provide only one score.

The third die 158 forms a bead 166 on the shell 18 having the scores so formed, as shown in FIGS. 7*a* and 7*b*, and as a result, a closure body 22 is formed. The provision of the score described above tends to deflect the bottom portion 150 of the closure body 22 downwardly in the manner shown in FIG. 7*b*. The bead 166 serves to absorb this deflection and adjust the shape of the bottom portion of the closure body 22. In the illustrated embodiment, the bead 166 is nearly C-shaped. If desired, it may be in another form, for example, a circular form.

The first moving conveyor device 140 includes a lifting member 168, a belt 172, a magnet 174, a drive wheel 176 to be driven continuously by a driving means (not shown), and an idler wheel 178. Since the magnet 174 extends only halfway along the lower portion of the belt 172, the closure body 22 supported on the under surface of the belt 172 by the attracting force of the magnet 174 drops when it is conveyed past the magnet 174.

The reversing device 142 has a helical guide passage and turns the closure body 22 upside down after the closure body has been fed from the first moving conveyor device 140.

The second moving conveyor device 144 includes a belt 180 and a driving wheel 182 and an idler wheel 184 supporting the belt 180. The driving wheel 182 continuously drives the belt 180 and sends the closure body 22 received from the reversing device 142 to a feed device 146.

The feed device 146 (FIGS. 1 and 11) is comprised of a stacker 186, a separator 187, a roller 190 having a plurality of bars 188, and a guide member 192.

The stacker 186 receives closure bodies 22 from the second moving conveyor device 144 and holds them in a stacked condition.

The roller 190 rotates continuously in synchronism with the movement of the belt 180, and moves the closure bodies 22 to the guide member 192 after the separator 187 separates the stack on the stacker 186 into individual closure bodies 22.

The guide member 192 has a side wall 194 extending partly along the outside ends of the bars 188 of the rotating roller 190, a bottom wall 196 and an upper surface 198, and feeds the closure bodies 22 together with the roller 190 to the direction matching section 14.

In the closure body producing section 12, the conveyor belt 132 and the shells 18 supported on it are intermittently driven, and the three sets of dies 154, 156 and 158 supported on the pressurizing device 160 of the press 138 are simultaneously driven to work the shells 18. The press 138 can advantageously and rapidly work the workpiece, i.e. the shell, by intermittently driving the workpiece. Since the conveyor belt 132 and the shells 18 are of relatively light weight, they have a relatively low inertia during intermittent driving, and can be driven intermittently at high speeds.

In the embodiment described above, the closure body producing section 12 is connected to the direction matching section 14. If desired, instead of this embodiment, these sections 12 and 14 may be separately provided. In this case, closure bodies 22 produced in the closure body producing section 12 may be stored temporarily and then carried to the direction matching section 14. Thus, the first moving conveyor device 140, the reversing device 142, and the second moving conveyor device 144 may be omitted.

Direction matching section

Figure 1:
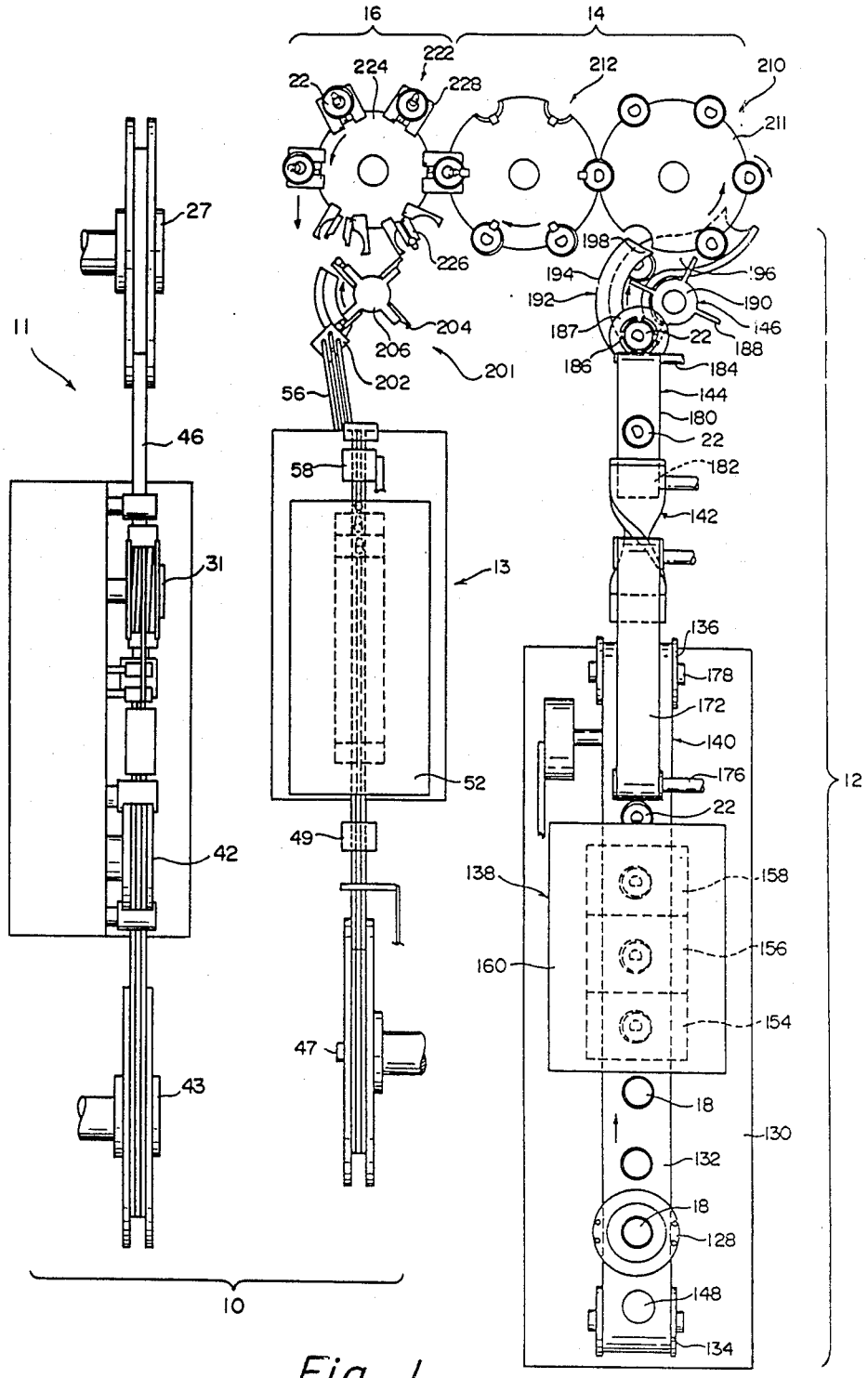
FIG. 1 is a top plan view of an apparatus for carrying out the process of the present invention in accordance with one embodiment thereof.

The direction matching section 14 will be described in detail with reference to FIGS. 1, 12 and 13.

The direction matching section 14 includes a direction matching device 210 and a transfer device 212.

The direction matching device 210 (FIGS. 12 and 13) includes a continuously rotating turntable 211, a plurality of holding members 216 provided on the rotating plate 211, and a friction plate 218 provided on a rotating plate 214.

The turntable 211 continuously rotates in synchronism with the conveyor belt 132 and the roller 190 of the closure body producing section 12 so that the closure bodies 22 are fed one by one between a set of holding members 216 and the friction plates 218 from the feed device 146.

The upper surface of the holding member 216 has a shape complementary to the under surface of the closure body 22. Each of the holding members 216 has a hole 220 having one end opened centrally in the upper surface of the holding member 216. The other end of the hole 220 communicates with a vacuum device (not shown) via a control device (not shown).

Figure 12:
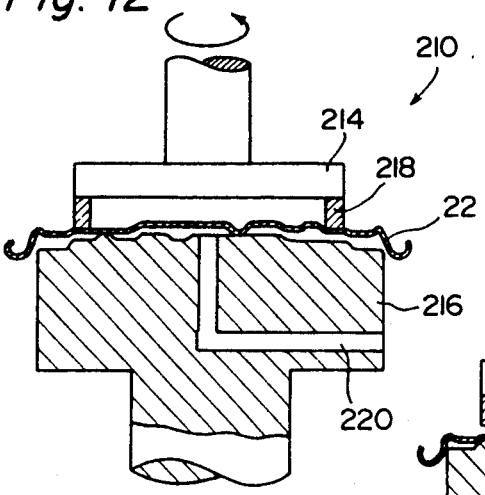
FIGS. 12 nd 13 are side elevations of the essential parts of the direction matching section of the apparatus shown in FIG. 1.
Figure 13:
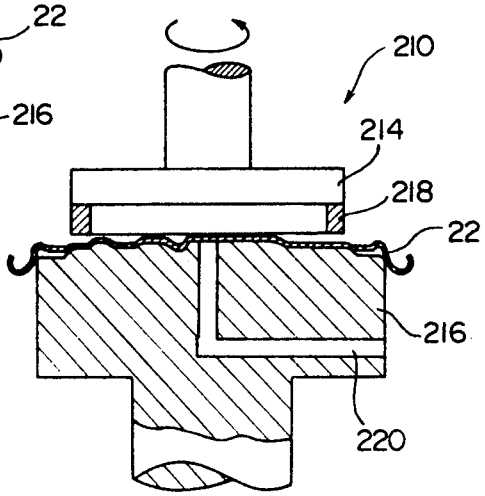

The friction plate 218 is rotated about its axis by a driving device (not shown), and moves the holding member 216 up and down in FIGS. 12 and 13. Alternatively, the friction plate 218 may be designed to move up and down.

The direction matching section 14 operates as follows: The closure body 22 is fed between the holding member 216 and the friction plate 218 from the feel device 146 of the closure body producing section 12. At this time, the holding member 216 is at a lowered position and is spaced from the friction plate 218. The hole 220 of the holding member 216 is brought into communication with the vacuum device. Thereafter, the holding member 216 rises, and the closure body 22 begins to make contact with the rotating friction plate 218. In rotating directions other than one in which the upper surface of the holding member 216 exactly matches the lower surface of the closure body 22, some space exists between the upper surface of the holding member 216 and the lower surface of the closure body 22 as shown in FIG. 12. For this reason, when a vacuum force is exerted on the closure body 22 via the hold 220, the closure body 22 rotates together with the friction plate when the rotating friction plate 218 contacts the upper surface of the closure body 22. When the closure body 22 is rotated in a predetermined angular direction as shown in FIG. 13, a sufficient vacuum force is exerted on the under surface of the closure body 22 from the hole 220. Consequently, the closure body 22 is fixed to the holding member 216 and sliding occurs between the upper surface of the closure body 22 and the friction plate 218. The rotating speed, etc. of the friction plate 218 is determined so that in whichever rotating direction the closure body 22 is fed between the holding member 216 and the friction plate 218 from the feed device 146, the closure body 22 is fixed at a predetermined angular position well before the closure body 22 is sent from the direction matching device 210 to the transfer device 212.

The direction matching device is not limited to the embodiment described above, and the following changes and modifications may be made.

While in the above embodiment a vacuum force is exerted on the holding member 216 by providing the hole 220 connected to the vacuum device, it is possible alternatively to provide a magnet on the holding member 216 and attract the closure body 22 by magnetic force.

It is also possible to provide the closure body 22 on the holding member 216, rotate the holding member with by a servomotor, detect a specific angular position electrically or optically, stop the servomotor, and hold the closure body at the specified angular position detected. Electrical detection of the specific angular position may, for example, be effected by using a proximity switch. The optical detection may be performed by using an optical sensor, or by subjecting the panel pattern of the closure body 22 to image processing and matching the direction of the closure body by utilizing such image processing.

In still another embodiment, a protruding portion extending downwardly in FIGS. 12 and 13 is provided in the closure body 22. The protruding portion extends sharply at one side in the circumferential direction and extends gently at the other side in the circumferential direction. A recess conforming to the protruding portion is provided in the holding member. If with this construction, the closure body is rotated in one direction on the holding member, it fails to rotate as soon as its protruding portion extends into the recess of the holding member. In this way, the closure body may be disposed at a predetermined angular position on the holding member.

The transfer device 212 receives the closure body 22 at a fixed angular direction with respect to the holding member 216, and feeds it to the bonding section in the predetermined angular direction.

Bonding section

The bonding section will be described in detail with reference to FIGS. 1 and 14.

The bonding section 16 includes a bonding device 222 comprised of a turntable 224, a tab clamp device 226, a closure body clamp device 228, a heating device 230 and a pressing device 232.

The turntable 224 continuously rotates in the direction shown by an arrow in synchronism with the rotation of the turntable 211 and transfer device 212 of the direction matching device 210.

The tab clamp device 226 holds a tab fed from the tab producing section 10 at a predetermined position with its adhesive layer 246 facing upward.

The closure body clamp device 228 receives the closure body 22 from the transfer device 212 of the direction matching section 14. Since the closure body 22 is held at a predetermined angular direction in the transfer device 212, all closure bodies 22 to be successively fed to the closure body clamp device 228 are held in the same angular direction.

Hence, the tab 20 and the closure body 22 are held at proper vertical, horizontal and angular positions by the tab clamp device 226 and the closure body clamp device 228.

The heating device 230 includes a supporting member 234, a ferrite member 236 supported by the supporting member 234, a high frequency coil 238 fixed to the ferrite member 236, and a conduit 240 disposed within the high frequency coil 238.

Figure 14:
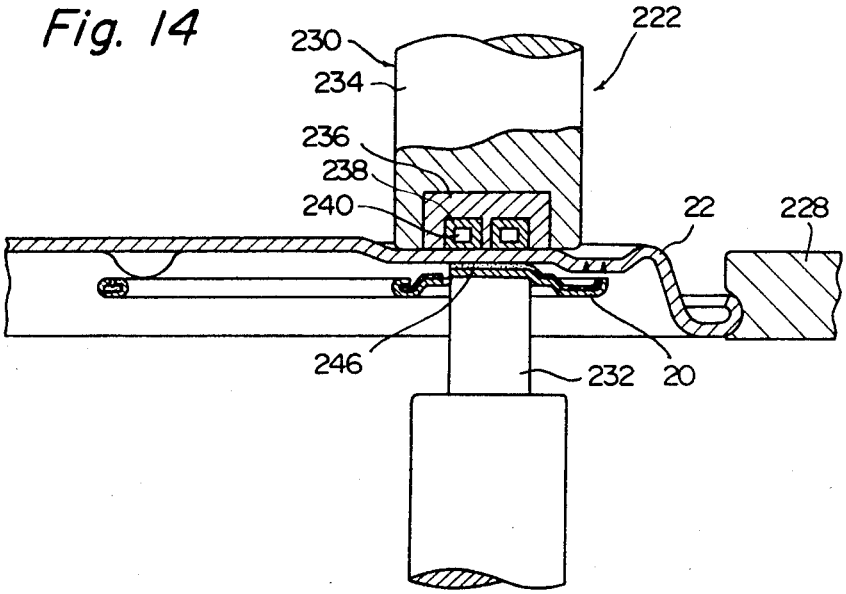
FIG. 14 is a side elevation of the essential parts of a bonding section in the apparatus of FIG. 1.

The supporting member 234 is moved up and down in FIG. 14 by a driving device (not shown). High frequency electromagnetic waves generated by the high frequency coil 238 are effectively sent to the closure body 22 by the ferrite member 236. A cooling medium is passed through the conduit 240 to prevent overheating of the high frequency coil 238.

The pressing device 232 is moved up and down in FIG. 14 by a driving device (not shown) and holds the closure body 22 and the tab 20 between it and the heating device 230 and presses the closure body 22 and the tab 20 together while heated.

In the bonding device 222 of the bonding section 16, the turntable 224 continuously rotates and the tab clamp device 226, the closure body clamp device 228, the heating device 230 and the pressing device 232 are provided on the turntable 224.

Bonding of the tab 20 to the closure body 22 must be effected by interposing an adhesive between the tab and the closure body and maintaining them pressed for a relatively long period of time. Since the heating device 230 and the other members are provided on the rotating plate 224 as described above, the tab 20 and the closure body 222 can be maintained pressed for a relatively long period of time. Intermittent rotation of the turntable 224 at a high speed is impossible because the heating device 230 and the other members on it are heavy. Since in the present invention the turntable 224 is rotated continuously, it can be moved at a high speed, and therefore, the bonding step can be carried out at a high speed.

Modification of the closure body producing section

A modified embodiment of the closure body producing section which may be used in place of the closure body producing section will be described.

For example, it is often necessary to display instructions for opening the closure on its surface in a written or pictorial form. Such instructions are generally printed by using a paint containing a pigment and a varnish.

When a tab is bonded to the printed surface of the closure body by using an adhesive, a sufficient bond strength cannot be obtained because the paint contains the pigment and the varnish. To overcome this disadvantage, the instructions are printed radially inwardly or outwardly of a bonding surface of the closure body in the production of the closure body by the closure body producing section so that the printed instructions do not overlap the bonding surface in whichever directions a panel, a score and a C-shaped bead are formed on the surface of the closure body. This, however, limits the area on which the instructions can be printed, and sometimes, the desired instructions cannot be displayed on the closure.

In the modified embodiment of the closure body producing section, the desired instructions are first printed on a metal blank from which a closure body is to be formed so that the printed area does not coincide with a surface to be bonded, and a cut is provided in the metal blank between a portion which is to become the closure body and another portion to facilitate subsequent working. The portion which is to become the closure body is not completely cut away from the other portion.

Thereafter, a shell of the type shown in FIGS. 4*a* and 4*b* is formed by drawing the metal blank using a double die press. The shell is subjected to a step of panel formation to provide a shape shown in FIGS. 5*a* and 5*b* which is then subjected to bead formation. The shell so worked has a shape similar to that shown in FIGS. 7*a* and 7*b*, but includes no score. It is partly linked to the remainder of the metal blank.

Since the shell is linked partly to the remainder of the metal blank, the panel and bead which have to be properly positioned with respect to the bonding surface can be easily formed.

After the above workings, the shell is cut away from the blank and a non-circular score which does not have to be positioned in any specific direction is then formed on the shell to produce a closure body. Such a non-circular score can be properly formed irrespective of its direction of arrangement.

Alternatively, the shell, while being partly linked to the remainder of the metal blank, may be subjected to the steps of drawing, panel formation, score formation and C-bead formation and then cut off from the blank to produce a closure body.

The closure body so produced, as in the embodiment described hereinabove, is sent to the directory matching section 14 and the bonding section 16 and a tab 20 is bonded to a predetermined site of the closure body.

Second modification of the closure body producing section

In place of the above modified example, a second modified example of the closure body producing section may be employed.

In the second modified embodiment of the closure body producing section, while a metal blank is intermittently moved, it is subjected simultaneously to a step of drawing, a step of panel formation and a step of bead formation and a shell separated from the blank is formed. By this working, the non-circular panel and bead which are properly positioned with respect to a non-printed part, i.e. a surface to be bonded, may be formed.

The shell so formed is intermittently moved, and a circular score is formed on it to provide a closure body having the shape shown in FIGS. 6*a* and 6*b*.

As desired, various workings for improving the characteristics of the closure body may be applied before, during or after shell formation or score formation. For example, distortion may occur as a result of the score formation. To remove it, press working may be supplementarily done simultaneously with, or after, the score formation.

In the above embodiment, the panel and bead are not circular (FIGS. 6*a* and 6*b*), but one of them could be circular. For example, a circular bead may be formed instead of the C-shaped bead. In this case, it is possible to form the non-circular bead at the same time as the step of drawing, separate the shell from the blank and then perform non-circular working.

It is important in this embodiment that the non-circular working should be carried out at the time of forming a shell from the metal blank. The circular working may be done simultaneously with the non-circular working, or may be done on the shell separately.

Materials

The metal blank from which the closure body is to be formed may be a surface-treated steel plate such as a tin plate or a TFS (tin-free steel) plate or an aluminum plate. Preferably, the metal blank has a thickness of 5 micrometers to 5 millimeters.

Resins containing amide recurring units and/or ester recurring units can be used as the adhesive. Specifically, they are, for example, homo- and co-polyamides or copolyesters having a melting or softening point of 50 to 300° C., particularly 80° to 270° C., or blends thereof.

Suitable aliphatic homo- or copolyamides are those having 4 to 14, particularly 5 to 12, amide recurring units per 100 carbon atoms. Preferably, the copolyamides contain at least 3 mole %, based on the entire amide recurring units, of amide recurring units different from the main amide recurring units. Examples of suitable homo- and co-polyamides are nylon 13, nylon 12, nylon 11, nylon 6-12, nylon 12/nylon 6, nylon 12/nylon 10, and dimeric acid-based polyamides.

The copolyesters are preferably those which contain 3 to 70 mole %, based on the entire ester units, of ester recurring units different from the main ester recurring units. Examples of the copolyesters are polyethylene terephthalate/isophthalate, polytetramethylene terephthalate/isophthalate, polyethylene terephthalate/adipate, polytetramethylene terephthalate/adipate, and polytetramethylene/ethylene terephthalate/dodecanoate.

These resins used as the adhesive should, of course, have molecular weights sufficient for film formation. The polymer blends may be a blend of polyamides with each other, a blend of copolyesters with each other, or a blend of a polyamide with a copolyester. For the purpose of modification, other resins such as ionomers, xylene resins and epoxy resins may be blended further.

If desired, known additives may be incorporated in such adhesives in accordance with known formulations. Examples of the additives are fillers, heat stabilizers, antioxidants, nucleus-forming agents, pigments, plasticizers, and lubricants.

"Instant adhesives", for example cyanoacrylate-type adhesives, may also be used.

A primer coating may be formed on the metal blank depending upon the type of the adhesive used.

The primer may be any known primer which has excellent adhesion to the metal blank described above and the thermoplastic adhesive composed of amide and/or ster recurring units, and may include thermosetting or thermoplastic resin paints. Specific examples are modified epoxy paints such as a phenol-epoxy paint, an amino-epoxy paint and an epoxy ester paint; paints from vinyl or modified vinyl paints such as a vinyl chloride/-vinyl acetate copolymer, a partial saponification product of a vinyl chloride/vinyl acetate copolymer, a vinyl chloride/vinyl acetate/maleic anhydride copolymer, and epoxy-modified vinyl resins, epoxyamino-modified vinyl resins, and epoxyphenol-modified vinyl resins; acrylic resin-type paints; oily paints; alkyd paints; polyester paints; and synthetic rubber-type paints such as a styrene/butadiene copolymer paint.

Typical primer paints having excellent adhesion and corrosion resistance are phenol-epoxy type paints composed of bisphenol epoxy resins and resol-type phenol-aldehyde resins derived from various phenols and formaldehyde, preferably containing the phenol resin and the epoxy resin in a weight ratio of from 90:10 to 5:95. These primers also have excellent processability, and have the advantage that scores formed on closure bodies produced from a metal blank coated with these primers have good corrosion resistance. Primer paints of this type are especially suitable when a polyamide-type adhesive is used.

Other typical examples of primers having excellent adhesion and corrosion resistance are paints comprising vinyl chloride copolymers having polar groups. They contain polar groups such as carboxyl, acid anhydride and epoxy groups in a concentration of 50 to 2,000 millimoles per 100 g of resin. These resins are obtained, for example, by copolymerizing acrylic acid, methacrylic acid, maleic anhydride, hydroxypropyl or hydroxyethyl acrylate or methacrylate, and glycidyl acrylate or methacrylate with vinyl chloride together with other comonomers. The hydroxyl group can be supplied by saponifying the vinyl acetate units in the copolymers, or by modifying the copolymer with epoxy resins or epoxyphenol paints.

The primer film may be constructed of a single layer, or a multiplicity of layers such as a combination of a base coat and a top coat.

There is no particular restriction on the thickness of the primer film so long as the aforesaid objects of the invention are achieved. Generally, the thickness of the primer film is preferably within the range of 0.2 to 30 micrometers, particularly 1 to 20 micrometers.

The metal plate from which the tab is produced may be a surface-treated steel sheet such as a tin plate or TFS or aluminum as in the closure, or a light metal plate such as an aluminum alloy. The tab may also be formed of a plastic material if it has sufficient rigidity.

The same primer layer as in the closure body may be provided on the adhesive layer of the tab.

What is claimed is:

1. A method of producing an easily openable closure, said method comprising:

producing at least one closure body by subjecting a shell to panel formation, score formation for defining a portion to be opened and bead formation while moving the shell intermittently, producing at least one tab, bringing a respective said tab produced and a respective said closure body produced together in a manner in which each said at least one closure body is matched with a respective said tab, placing a bonding surface of said each closure body opposite to a bonding surface of said respective tab; and bonding the bonding surface of said respective tab to the bonding surface of the closure body with an adhesive while moving said closure body and said respective tab continuously.

2. The method of claim 1 wherein the panel formation, score formation and bead formation are carried out by a plurality of dies driven by a single pressurizing device.

3. The method of claim 1 or 2, and further comprising holding each said respective tab on a holding member at a specific angular position at which the bonding surface of the closure body comes opposite to the bonding surface of said respective tab when said respective tab and the closure body are brought together.

4. A method for producing an easily openable closure, said method comprising:

a closure body producing step for producing at least one closure body by performing drawing, panel formation and bead formation on a portion of a metallic sheet material from which the at least one closure body is to be formed while said portion of the sheet material is partly connected to the remainder of the sheet material and is moved intermittently, and by performing score formation for defining a portion to be opened on said portion of the sheet material while moving said portion intermittently, a step of producing at least one tab, a step of bringing a respective said tab produced and a respective said closure body produced together in a manner in which each said at least one closure body is matched with a respective said tab, a step of placing said each closure body in such a position that a bonding surface of the closure body is disposed opposite to a bonding surface of said respective tab; and a step of bonding the bonding surface of said respective tab to the bonding surface of the closure body by an adhesive while moving the closure body and said respective tab continuously.

5. The method of claim 4 wherein the score formation is carried out while said portion of the sheet material from which the at least one closure body is to be produced is completely separated from the remainder of the sheet material.

6. The method of claim 4, wherein the score formation is carried out while said portion of the sheet material from which the at least one closure body is to be produced is partly linked to the remainder of the sheet material.

7. The method of claim 6, wherein the panel formation, score formation and bead formation are carried out by a plurality of dies driven by a single pressurizing device.

8. The method of any one of claims 4 to 7, and further comprising holding each said respective tab on a holding member in a specific angular position at which the bonding surface of the closure body is disposed opposite to the bonding surface of said respective tab when said respective tab and the closure body are brought together.

9. A method of producing an easily openable closure, said method comprising:

a step of producing at least one closure body by subjecting a sheet material to drawing, panel formation, bead formation and score formation for defining a portion to be opened while moving the sheet material intermittently, at least one of the panel formation and bead formation for forming a non-circular working, and the drawing and the at least one of the panel formation and the bead formation being performed simultaneously to form a shell, a step of producing at least one tab, a step of bringing a respective said tab produced and a respective said closure body produced together in a manner in which each said at least one closure body is matched with a respective said tab, a step of placing said each closure body in such a position that a bonding surface of the closure body is disposed opposite to a bonding surface of said respective tab; and a step of bonding the bonding surface of said respective tab to the bonding surface of the closure body by an adhesive while moving the closure body and said respective tab continuously.

10. The method of claim 9 wherein both the panel formation and bead formation are for forming non-circular workings, and the drawing, the panel formation and the bead formation are performed simultaneously.

11. The method of claim 9 wherein the panel formation, score formation and bead formation are carried out by a plurality of dies driven by a a single pressurizing device.

12. The method of any one of claims 9 to 11, and further comprising holding said respective tab on a holding member at a specific angular position at which the bonding surface of the closure body is disposed opposite to the bonding surface of said respective tab.

13. A method of producing an easily openable closure, said method comprising:

a step of producing at least one closure body by performing panel formation, score formation for defining a portion to be opened and bead formation on a shell while moving the shell intermittently, a step of producing at least one tab by applying an adhesive to a metal blank and by forming a tab from the metal blank having the adhesive applied thereto, a step of bringing a respective said tab produced and a respective said closure body produced together in a manner in which each said at least one closure body is matched with a respective said tab, and;

a bonding step of bonding said respective tab to the closure body by said adhesive while moving the closure body and said respective tab continuously.

14. The method of claim 13 wherein the tab producing step comprises applying the adhesive to the metal blank at spaced sites thereon.

15. The method of claim 13, wherein the tab producing step comprises, the applying adhesive as a continuous tape to the metal blank.

16. The method of claim 1, wherein the tab producing step comprises forming the at least one tab by punching and bending an adhesive-applied metal blank by using a punch.

17. The method of claim 1, wherein the bonding step comprises bonding with a thermoplastic adhesive.

18. A method for producing an easily openable closure, said method comprising:

a closure body producing step for producing at least one closure by performing drawing, panel formation and bead formation on a portion of a metallic sheet material from which the at least one closure body is to be formed while said portion of the sheet material is partly connected to the remainder of the sheet material and is moved intermittently, and by performing score formation for defining a portion to be opened on said portion of the sheet material while it is intermittently moved, a tab producing step for producing at least one tab by applying an adhesive to a metal blank and forming at least one tab from the metal blank having the adhesive applied thereto, a step of bringing a respective said tab produced and a respective said closure body produced together in a manner in which each said at least one closure body is matched with a respective said tab; and a bonding step of bonding the closure body and said respective tab with said adhesive while moving the closure body and said respective tab continuously.

19. The method of claim 18, wherein the score formation is carried out while said portion of the sheet material from which the at least one closure body is to be produced is completely separated from the remainder of the sheet material.

20. The process of claim 18 wherein the score formation is carried out while said portion of the sheet material from which the at least one closure body is to be produced is partly linked to the remainder of the sheet material.

21. The method of any one of claims 18 to 20, wherein the tab producing step comprises applying the adhesive to the metal blank at spaced sites thereon.

22. The method of any one of claims 18 to 20, wherein the tab producing step comprises applying the adhesive as a continuous tape to the metal blank.

23. The method of any one of claims 18 to 20, wherein in the tab producing step comprises punching and bending the metal blank having the adhesive by using a punch.

24. The process of any one of claims 18 to 20, wherein the application adhesive comprises applying thermoplastic adhesive.

25. A method of producing an easily openable closure, said method comprising:

a step of producing at least one closure body by subjecting a sheet material to drawing, panel formation, bead formation and score formation for defining a portion to be opened while moving the sheet material intermittently, at least one of the panel forming and bead forming for producing a non-circular working, and the drawing and the at least one of the panel forming and the bead forming being performed simultaneously to form a shell, a tab producing step of applying an adhesive to a metal blank and forming at least one tab from the adhesive-applied metal blank, a step of bringing a respective said tab produced and a respective said closure body produced together in a manner in which each said at least one closure body is matched with a respective said tab; and a step of bonding the bonding surface of said respective tab to the bonding surface of the closure body with said adhesive while moving the closure body and said respective tab continuously.

26. The method of claim 25, wherein both the panel formation and bead formation are for forming non-circular workings, and the drawing, the panel formation and the bead formation are performed simultaneously.

27. The method 1 of claim 25 or 26 wherein, the tab producing step comprise applying the adhesive to the metal blank at species sites thereon.

28. The method of claim 25 or 26, wherein the tab producing step comprises applying the adhesive as a continuous tape to the metal blank.

29. The method of claim 25 or 26, wherein the tab producing step comprises forming the at least one tab by punching and bending the adhesive-applied metal blank by using a punch.

30. The method of claim 25 or 26, wherein the applying of adhesive comprises applying thermoplastic adhesive.

* * * * *